United States Patent [19]

Deckard

[11] 4,046,112

[45] Sept. 6, 1977

[54] ELECTROMAGNETIC FUEL INJECTOR

[75] Inventor: John I. Deckard, Grand Rapids, Mich.

[73] Assignee: General Motors Corporation, Detroit, Mich.

[21] Appl. No.: 623,947

[22] Filed: Oct. 20, 1975

[51] Int. Cl.[2] ..... F02M 39/00

[52] U.S. Cl. ..... 123/32 JV; 123/32 AE; 123/139 E

[58] Field of Search ..... 123/32 AE, 32 JV, 139 E; 239/96, 585

[56] References Cited

U.S. PATENT DOCUMENTS

| | | | |
|---|---|---|---|
| 3,689,205 | 9/1972 | Links | 123/139 E X |
| 3,796,205 | 3/1974 | Links et al. | 123/139 E |
| 3,921,604 | 11/1975 | Links | 123/139 E |

*Primary Examiner*—William B. Cline
*Attorney, Agent, or Firm*—Arthur N. Krein

[57] ABSTRACT

An electromagnetic fuel injector with a differential pressure actuated injector valve therein to control fuel injection is supplied with fuel at a predetermined supply pressure, the injector having incorporated therein a hydraulic fluid (fuel) powered booster pump means operable to increase the pressure of fuel from the original supply pressure to a higher injection pressure for effecting operation of the injector valve, the flow of hydraulic fluid (fuel) to effect operation of the booster pump means being controlled by a solenoid actuated valve means controlling inlet and discharge of fuel to a fluid control chamber in communication with the power piston of the booster pump through a control or metering orifice of predetermined size, whereby the rate of pressure intensification of fuel to the injector valve is controlled.

3 Claims, 3 Drawing Figures

ELECTROMAGNETIC FUEL INJECTOR

Figure 1:
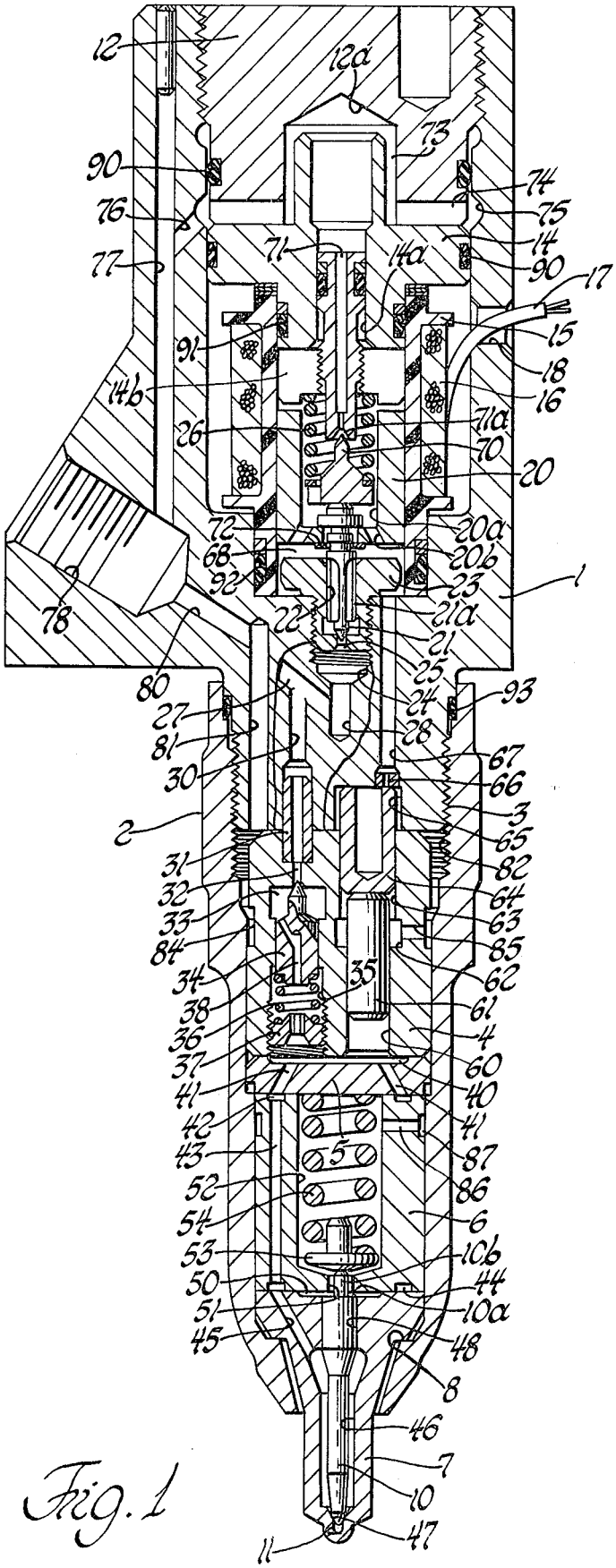

This invention relates to a fuel injection apparatus and, in particular, to an electromagnetic fuel injector for internal combustion engines, particularly diesel engines.

Various forms of electromagnetic fuel injectors for internal combustion engines are well known. In one such type of fuel injector, the injector is coupled to a pressure source of fuel which supplies fuel at a predetermined supply pressure, this pressure then being intensified within the injector to a higher injection pressure to effect actuation of a needle-type injector valve slidably mounted in the spray tip of the injector. The means for intensifying the pressure within the injector may either take the form of a spring actuated piston or may take the form of a booster pump consisting of a pump piston driven by a servo piston having a diameter greater than that of the pump piston. In this type of injector, the operation of the piston arrangements of their respective intensifying means is effected by means of the fuel supply pressure with flow thereof controlled by one or more solenoid actuated valve means actuated by a control device synchronously with the engine.

In one such known type fuel injector, the solenoid actuated valve means is used to control the positioning of a spool valve which in turn, in one position, controls the flow of fuel at the supply pressure to the servo piston and, in another position, controls the flow of fuel from the servo piston into a fuel return conduit. It will be apparent that this type fuel injector would be both complicated and expensive to make and would in all probability provide a sluggish response to the signals supplied by the control device, due to the necessity of effecting movement of a relatively large mass spool valve.

It is therefore the primary object of this invention to provide an improved electromagnetic fuel injector having incorporated therein a hydraulic fluid (fuel) powered booster pump means operable to increase the fuel supply pressure within the injector to a higher fuel injection pressure, with flow of hydraulic fluid to and from the booster piston of the booster pump means controlled by a solenoid actuated valve means with the hydraulic fluid to the booster piston flowing through a control metering orifice of predetermined diameter.

Another object of this invention is to provide an improved electromagnetic fuel injector, for an internal combustion engine, which can be readily detailed to control the rate of injection and the rate/time profile, as necessary, for a particular engine, in order to optimize engine combustion, reduce peak engine combustion temperatures, and result in reduced engine noise.

A further object of this invention is to provide an improved electromagnetic fuel injector which is of simple and compact structure and which is economical to manufacture.

A still further object of this invention is to provide an improved electromagnetic fuel injector that is operable to provide both a variable pilot injection and a main fuel charge injection.

These and other objects of the invention are obtained by an electromagnetic fuel injector for a diesel engine which includes an injector housing enclosing at one end thereof an electromagnetic means having a movable armature carrying a control valve and an opposed retractor valve both movable as a unit with the armature to control the ingress and egress of fluid to a control chamber within the injector housing, the injector housing at its opposite end providing a spray tip with spray orifice passages therethrough with flow therefrom controlled by a pressure actuated injector valve slidably mounted within the injector housing. A stepped booster piston and cylinder arrangement is also enclosed within the injector housing, the primary side of the stepped booster piston and cylinder arrangement being supplied with fuel from a high pressure source at a predetermined supply pressure via the control chamber in communication with the primary side via a control orifice, flow to the control chamber from the source being regulated by the control valve as operated by the electromagnetic means, the control chamber also being in communication with a fuel return bleed orifice, flow through which is controlled by the retractor valve also operable by the electromagnetic means. The secondary side of the stepped booster piston and cylinder arrangement and a fuel chamber surrounding the injector valve are also supplied with fuel at supply pressure through a supply orifice and check valve, the pressure of this fuel during operation of the stepped booster piston and cylinder arrangement being intensified to a high injection pressure to effect operation of the injector valve.

Figure 2:
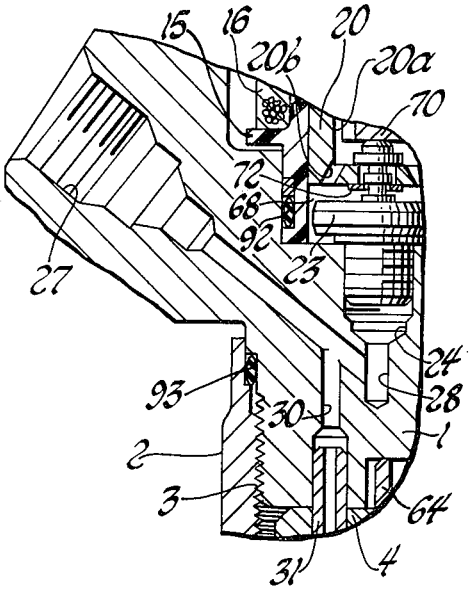
Figure 3:
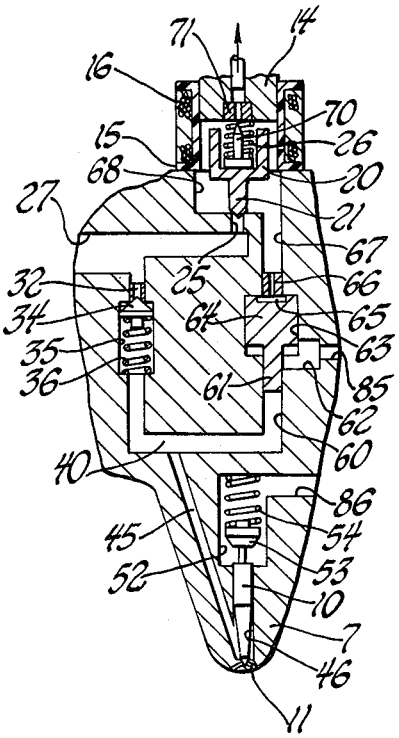

For a better understanding of the invention, as well as other objects and further features thereof, reference is had to the following detailed description of the invention to be read in connection with the accompanying drawings, wherein:

FIG. 1 is a longitudinal sectional view taken through an electromagnetic fuel injector in accordance with the invention showing the arrangement of the fuel booster pump therein and the controls thereof whereby fuel to actuate the injector valve of the unit is intensified over the pressure of fuel supplied from a high pressure source to the injector, the elements of the injector being shown with the electromagnetic means thereof deenergized;

FIG. 2 is a fragmentary view of a portion of FIG. 1 showing the fuel inlet passages of the injector; and, FIG. 3 is a schematic illustration of the primary operating elements of the injector of FIG. 1.

Referring now to the drawings in detail, and first to FIG. 1, the injector includes an elongated body 1 and a hollow cylindrical valve nut 2 whose upper end is threadedly connected, as at 3, to the body 1 to provide an injector housing with the valve nut 2 retaining therein, in sequence, a valve cage 4, a spacer or crossover disk 5, a valve spring cage 6 and a spray tip 7 with the valve cage 6 in abutment at one end with the lower surface of body 1 and the head of the spray tip 7 at the other end being in abutment against an internal flange 8 of the valve nut 2. A needle-type injector valve 10, of known construction, is movable positioned in the spray tip 7 to control the discharge of fuel through the spray orifices 11 in the lower end of the spray tip 7.

The upper end of body 1 is formed with a stepped counterbore to provide an internal chamber closed at one end by a cap nut 12 threaded into the upper end of the body 1. An electromagnetic unit in the form of a solenoid assembly is mounted within this chamber at the upper end of the body, the solenoid assembly including a core 14, suitably fixed in the body 1, having a tubular bobbin 15 fixed thereto and a coil 16 surrounding the bobbin 15. The lead 17 to the coil 16 extends outward through an aperture 18 in the side wall of the body 1 for connection to a suitable electrical control device, not shown.

The solenoid assembly also includes a movable cup-shaped armature 20 to which one end of a depending needle-type charge control valve 21 is secured for movement therewith. The charge control valve 21, which has a splined intermediate portion 21*a*, is reciprocably received in the stepped axial bore 22 of a valve cage 23, the lower end of this cage being threaded into a suitable portion of the counterbore forming, in part, the passage 24 within the body 1. The lower end of the bore 22 in the valve cage 23 provides a metering charge orifice passage 25, flow through which is controlled by the conical valve tip of the charge control valve 21. A compression spring 26, with a predetermined spring rate and force positioned within the chamber of a cup-shaped armature 20, is used to normally bias the charge control valve 21 into a closed position relative to the metering charge orifice passage 25. As shown, the spring 26 is in abutment at one end against the radial slotted lower end 14*b* of the core 14 whereby to bias the charge control valve 21 in a direction, downward with reference to FIG. 1, to cause it to seat relative to the metering charge orifice passage 25 against the force of fuel pressure in the passage 24, fuel being delivered to this passage 24 in a manner to be described.

Fuel from a source of high supply pressure fuel, not shown, is introduced to the passage 24 at a supply pressure P*s* via an inlet port or passage 27 and a passage 28 coaxial with the passage 24 in the body 1. This fuel is at a high supply pressure P*s*, which is a pressure substantially less than the injection pressure P*i*, to be described, required to effect unseating or "popping" of the injector valve 10. Inlet passage 27 also connects, via a longitudinal passage 30 in body 1 and an interconnecting tubular dowel 31, to a restricted passage or supply orifice 32 formed in valve cage 4 and then to an enlarged chamber 33 also provided in the valve cage 4, flow from the supply orifice 32 to the chamber 33 being controlled by a regulator or check valve 34 slidably journalled in a portion of a stepped bore 35 provided in valve cage 4 coaxial with supply orifice 32. Check valve 34, which is a one-way valve, is normally biased to a closed position relative to supply orifice 32 by a spring 36 abutting at one end against the check valve 34 and at its other end abutting against an apertured spring seat 37 threadedly secured in the lower end portion of bore 35 opposite chamber 33.

Fuel flowing into chamber 33, when the check valve 34 is unseated, can flow via a longitudinal extending through passage 38 in check valve 34, bore 35 and through the apertured spring seat 37 into an annular fuel chamber 40 provided, in the construction shown, by a recess formed in the upper end of the crossover disk 5 next adjacent to the valve cage 4. The fuel chamber 40 is connected by passages 41 through the crossover disk to an annular groove chamber 42 at one end, the upper end with reference to FIG. 2, of the valve spring cage 6 and then by at least one longitudinal extending passage 43 therein to a second annular groove chamber 44 at the opposite end of the valve spring cage 6. The groove chamber 44 is in communication via a drill passage 45 in the spray tip 7 to the annular passage 46 therein surrounding the needle valve 10, this passage 46 being in communication with the spray orifice 11 at the lower end of the spray tip 7, as controlled by the injector valve 10. Passages 41, groove chambers 42 and 44 and passages 43, 45 and 46 may be referred to as the fuel delivery passage or "tip passage".

As previously described, discharge of fuel through the spray orifices 11 is controlled by the injector valve 10 whose lower conical end normally closes off fuel flow through these spray orifices 11 by engaging the frusto-conical seat 47 within the spray tip adjacent to its lower end upstream of spray orifices 11. The injector valve 10 is slidably guided by its enlarged upper end in the bore 48 at the upper end of the spray tip 7, the bore 48 terminating at its upper end in an annular recess 50 formed in the upper end surface of the spray tip 7. The bore 48 and annular recess 50 are coaxially aligned, in the construction shown, with a bore 51 in the lower end of the valve spring cage 6, the bore 51 extending to a spring chamber 52 in the valve spring cage as provided by the cup-shaped configuration of this cage. The upper end of the spring chamber 52 is closed by the lower surface of the crossover disk 5 which is sandwiched between the valve spring cage 6 and the lower end of valve cage 4, the valve spring cage 6 and the crossover disk 5 together with a portion of valve cage 4 having a predetermined radial clearance between their respective outer peripheries and the respective inner peripheries of the valve nut 2, whereby the spring chamber 52 can be vented in a manner and for a purpose to be described.

The injector valve 10, in the construction shown, is provided at its upper end with a radial shoulder 10*a* and with a pin portion 10*b* extending therefrom to be loosely received in the bore 51 so as to extend into the spring chamber 52 whereby it can abut against a valve spring seat 53. The injector valve 10 is thus normally movable to an unseated position relative to seat 47 against the biasing action of a coiled valve spring 54 located in the spring chamber 52, this spring 54 being seated at its upper end against the crossover disk 5 and at its lower end on the valve spring seat 53, with movement of the injector valve in the opening direction being limited by engagement of the shoulder 10*a* thereof against the bottom surface of the valve spring cage 6.

The spray tip assembly and spring cage assembly, thus far described, is such that unseating of the injector valve 10 will occur with fuel in the annular passage 46 at an injection pressure P*o*, which pressure is greater than the supply pressure P*s*, and the injector valve 10 will close as a closing pressure P*c*. The injection pressure P*o* is congruent to the closing pressure P*c* plus the force of the spring 54.

Fuel in fuel chamber 40 is also in communication with the lower end of a stepped bore extending through the valve cage 4, this stepped bore defining, in sequence, starting from the lower end of the valve cage 4, with reference to FIG. 1, a secondary or pump cylinder 60 slidably receiving a secondary or pump piston 61 therein, an annular enlarged spill chamber 62 and a primary or servo cylinder 63 slidably receiving a primary or servo piston 64, of upstanding cup-shape configuration therein. The pistons 61 and 64 are hereinafter referred to as the secondary piston and primary piston, respectively. The spill chamber 62, for a purpose which will become apparent, is of a larger internal diameter than both the primary and secondary cylinders. The primary piston 64 is of a predetermined diameter which is greater than the predetermined diameter of the secondary piston 61 to obtain the necessary intensification of the fuel supply pressure, in a manner to be described, to a higher injection pressure as required in a particular engine application. Although the secondary piston 61 and primary piston 64 are formed as separate elements, in the embodiment shown, to provide a hydraulic fluid (fuel) operated fuel booster pump or servo operated pump mechanism, it is to be realized that these elements could be combined into a unitary stepped piston structure to perform the same function.

The upper open end of the primary piston 64, in the structure shown, loosely extends into an annular hydraulic fluid (fuel) servo pump chamber or supply chamber 65 formed in the lower end of the body 1 to be substantially concentric with the primary cylinder 63. This supply chamber 65 is connected via a metering or control orifice 66 and a passage 67 in the body 1 to an annular control chamber 68 surrounding the upper end or head of the valve cage 23 that is loosely encircled by the bobbin 15 of the solenoid assembly. The control chamber 68 is supplied with fuel at supply pressure P*s* through the previously described passages 27, 28, 24, through the metering charge orifice passage 25, flow through which, as previously described, is controlled by the charge control valve 21 and through the passage defined by the axial bore 22 in the valve cage 23 and the splined outer intermediate portion 21*a* of the charge control valve 21. The chamber 20*a* provided by the central bore in cup-shaped armature 20 is also in communication with the control chamber 68 via the passages 20*b* extending through the base of the armature 20.

A bleed or retractor valve 70 is loosely positioned in the chamber 20*a* of the armature 20 to control fluid flow from the chamber 20*a* through an injector bleed or retractor orifice 71*a* at the lower end of the injector retractor valve orifice tube 71 that is adjustably, threadedly secured in the central through bore 14*a* of the core 14. Retractor valve 70 is movable with the armature 20 since it is engaged by the opposite end of the previously described compression spring 26 whereby it is forced into abutment with the upper end of the charge control valve 21 which, as previously described, is suitable secured to the base of the armature 20 for movement therewith. In the construction shown, the radial flange of this charge control valve 21 engages the inside surface of the base of the armature 20, while a snap ring retainer 72 positioned in a suitable annular groove provided for this purpose in the charge control valve 21 engages the opposite or bottom side surface of the base of the armature.

Central bore 14*a* of the core 14 and, therefore, the orifice tube 71, are in communication with an annular chamber 73 surrounding the reduced diameter upper end portion of the core 14 that projects into the annular cavity 12*a* at the lower end of the cap nut 12. This chamber 73 is in communication, via radial passages 74 in the lower end of the cap nut 12, with an annular groove 75 in the interior of the body 1, a radial passage 76 then connecting this annular groove 75 to a longitudinal extending drain passage 77 which intersects a return port or outlet passage 78 in the body 1, the outlet passage 78 being adapted for connection to a fuel-return conduit, not shown, which is normally connected to a fuel reservoir, not shown, in which the fuel is at approximately atmospheric pressure.

Outlet passage 78 is also connected via passages 80 and 81 in body 1 to an annular drain chamber 82 encircling the upper part of the valve cage 4 and which is provided in part by the upper outer peripheral surface of valve cage 4 that is radially spaced inward from the inner peripheral surface of the valve nut 2 and in part by an annular groove 84 around the valve cage 4, the annular groove 84 being in communication via a radial passage 85 with the spill chamber 62 intermediate the cylinders 60 and 63 in the valve cage 4.

Internal leakage is drained from the spring chamber 52 of the valve spring cage 6 through a radial passage 86 to an annular groove 87 on the outer periphery of the valve spring cage 6, fuel then flowing from this annular chamber through the previously described clearance space between the valve spring cage 6 and the valve nut 2, the clearance between the crossover disk 5 and the valve nut 2 and the clearance between the lower end of valve cage 4 and the valve nut 2 to the annular groove 84 in valve cage 4 from whence it can then flow out the previously described outlet passages 78 to the fuel-return conduit, not shown. With this latter arrangement, the spring chamber 52 is normally maintained at a relatively low pressure corresponding to the outlet pressure of the fuel in the fuel return conduit. This same low pressure also acts on the upper end of the injector valve 10.

The sections of the injector body and the elements associated therewith which are subjected to different pressures are sealed relative to one another by suitable seal means 90, 91, 92 and 93.

A clearer understanding of the operation of the subject electromagnetic fuel injector just described can best be obtained by reference to the schematic illustration of this injector shown in FIG. 3, together with the following description.

During engine operation, the injector will be supplied from a suitable source, not shown, with fuel at a suitable high supply pressure P*s* through the inlet 27, this pressure P*s* being sufficient to effect unseating of the check valve 34 to permit fuel to flow into the chamber 40 and from there into secondary or pump cylinder 60 and into the fuel delivery passage or "tip passage" of the injector. Fuel at the supply pressure P*s* will also be present in the passages 28 and 24 and, of course, the control chamber 68 will also be full of fuel.

Thus, when an electrical current pulse from an electrical control device, not shown, energizes the coil 16, the armature 20 will lift against the biasing action of spring 26 thereby lifting the charge control valve 21 to permit flow from the passage 24 through the metering charge orifice passage 25 into the control chamber 68, while at the same time the retractor valve 70 will close to block flow of fuel from the control chamber 68 out through the retractor orifice 71*a* of the retractor valve orifice tube 71. This action will allow the fuel at supply pressure P*s* to flow through the control chamber 68 and through the passage 67 and control orifice 66 into the fuel supply chamber 65 to actuate the primary piston 64 thereby also effecting actuation of the secondary piston 61, in a direction to effect a pump stroke, the direction being downward with reference to the drawings. Since the primary piston 64 is of a substantially larger diameter than the secondary piston 61, the action of these pistons will effect an intensification of the pressure of the fuel in secondary or pump cylinder 60 and, of course, in the chamber 40 at a controlled rate determined by the flow rate through the control orifice 66.

The volume of fuel captured within the pump cylinder 60, chamber 40 and in the injector "tip passage" by the check valve 34 is thus pressurized or intensified from the supply pressure P*s* to an opening or injection pressure P*o* for the particular spray tip assembly. The injection pressure/time profile for the subject injector is substantially instantaneous from the supply pressure P*s* to the injection needle opening or injection pressure P*o* and then proceeds to increase at a rate determined by the flow rate of hydraulic fluid (fuel) through the control orifice 66 into the supply chamber 65 until the maximum (designed) pressure for the injector is achieved or, until the electromagnet is de-energized by cutting off the electrical pulse to the coil 16. For example, in a particular embodiment of the subject injector, pressure increases of from 2,000 psi per millisecond to 10,000 psi per millisecond have been obtained by the use of different sized orifice passages through the control orifice 66.

During operation of the booster pump arrangement, the fuel within the secondary cylinder 60 and supply chamber 40 is free to pass through the "tip passage", all of which may be considered as part of the secondary or pump chamber, so that, as the fuel pressure is intensified to the injection pressure P*o,* the fuel at this pressure will act against the injection valve 10 to raise this valve off the seat 47 and permit injection of the fuel via the spray orifices 11 into the cylinder of the engine, not shown. As will be apparent, this injection pressure P*o,* to effect unseating of the injector needle valve, acts substantially only against the biasing force of the spring 54, since the spring chamber 52 is vented through the radial passage 86 to the exterior of the valve spring cage 6. While a relatively close fit exists between the valve spring cage 6 and the valve nut 2, as well as between the valve nut 2 and the crossover disk 5, and between the lower end of valve cage 4 and valve nut 2, there is sufficient diametral clearance between these parts for such necessary venting of the spring chamber 52 to the annular groove 84 and drain chamber 82 whereat the fuel is at a relatively low return fuel line pressure, as previously described.

De-energizing the coil 16 will allow the spring 26 to effect closure of the charge control valve 21 blocking flow of fuel from the passage 24 into the control chamber 68 and at the same time effecting unseating of the retractor valve 70 relative the retractor orifice 71*a* allowing the bleed-down of fuel pressure from the control chamber 68 and, of course, from the fuel supply chamber 65 via the control orifice 66 and passage 67 to the return port or outlet passage 78, through the flow passages previously described, with this pressure being lowered at a predetermined decay rate to provide a predetermined injection pulse profile, as desired, by proper sizing of the retractor orifice 71*a* in the retractor valve orifice tube 71. This causes the fuel pressure in the fuel supply chamber 65 and in the pump cylinder 60 to drop abruptly permitting fuel at the supply pressure P*s* to effect unseating of the check valve 34 so that fuel at the supply pressure P*s* acting on the secondary or pump piston 61 causes it and the primary piston 64 to move in a direction, upward with reference to the drawings, to effect intake of fuel into the pump cylinder 60 at a controlled rate as controlled by the flow rate through the supply orifice 32.

It will be realized that the pressure/time radiant for intensifying the supply fuel pressure P*s* to an injection pressure P*o* can be controlled, as desired, by sizing of the orifice passage 66 and, of course, by proper sizing of the retraction orifice 71*a,* the pressure decay profile (rate) of the injection pulse can be controlled, as desired. The flow of fuel through the supply orifice 32 and the charge orifice 25 is also controlled by proper sizing of these orifices. Thus, in particular embodiments of the subject fuel injector, the diameter of the control orifice 66 ranged from 0.006 to 0.010 inch; the diameter of retractor orifice 71*a* ranged from 0.017 to 0.023 inch; the diameter of the charge orifice 25 ranged from 0.0355 to 0.0365 inch; and, the diameter of the supply orifice 32 ranged from 0.029 to 0.033 inch. It will be apparent from the above given dimensions that the diameter or section flow area of the retractor orifice 71*a* is sized larger than the control orifice 66 to permit the rapid decay of pressure for terminating injection.

Since the subject electromagnetic fuel injector has incorporated therein a differential piston or servo arrangement for intensifying fuel at a supply pressure P*s* to a higher injection pressure P*o,* it can be readily used with commercially available supply pumps rated at relatively low supply pressures, for example, from 3,000 psi to 6,000 psi. Thus, by proper sizing of the primary piston 64 relative to the secondary piston 61, fuel delivered to the injector at a supply pressure P*s* can readily be intensified therein to an injection pressure P*o* exceeding, for example, 10,000 psi.

Because of the substantially instantaneous intensification of the supply fuel pressure P*s* to an injection pressure P*o* upon energization of the coil of the electromagnetic unit of the subject injector, and because of the control of the pressure decay profile (rate) of the injection pulse, in the manner previously described, the subject injector can readily be operated to provide both a "pilot" charge, which can be varied, as desired, and then a "main" fuel charge by the proper timed energizing and de-energizing of the electromagnetic unit. Thus, with the subject fuel injector, the injection can be effected in two distinct phases, if desired, that is, a "pilot" or primary injection and a "main" or secondary injection with a "gap" or time interval therebetween.

Thus, there is disclosed an electromagnetic fuel injector, the details of which can be varied, as desired, to meet the particular fuel requirements of an engine. In addition, this injector is capable of providing pilot injection which can be varied in duration, lead time and fuel content relative to the main fuel charge injection.

What is claimed is:

1. A fuel injector for an internal combustion engine, said fuel injector including a housing means having a spray tip outlet means at one end thereof, a spring-biased injector valve slidably mounted in said housing means for controlling flow through said spray tip outlet means, said injector valve providing with said injector housing a tip passage means in communication with said spray tip outlet means as controlled by said injector valve, said housing having an inlet port for connection to a source of high pressure fuel, a return port for connection to a low pressure fuel reservoir and, a control chamber, passage means including a check valve controlled orifice passage operatively connected at one end to said inlet port and at its other end to said tip passage and a charge orifice passage also operatively connected at one end to said inlet port and at its other end to said control chamber, a bleed return passage means including a bleed orifice connected at one end to said control chamber and at its other end to said return port, a stepped booster pump cylinder means in said housing defining a secondary pump chamber in fluid communication with said tip passage means and a primary pump chamber of larger diameter than said secondary pump chamber, a fuel charge passage means including a control orifice in communication at one end with said control chamber and at its opposite end with said primary pump chamber, a stepped piston means reciprocably received in said booster pump cylinder means and a solenoid actuated valve means positioned in said injector housing for movement between a first position to control the flow of fluid through said charge orifice passage into said control chamber for flow to said primary pump chamber while blocking flow of fluid from the said control chamber through said bleed orifice and a second position blocking flow of fluid through said charge orifice passage into said control chamber while permitting flow of fluid from said control chamber through said bleed orifice, said control orifice being of smaller size than the size of said bleed return orifice, said bleed orifice and said charge orifice passage being axially aligned in spaced apart relation to each other and, said solenoid actuated valve means including a solenoid having a movable armature supporting a retractor valve and an opposed axially aligned control valve for movement therewith relative to said bleed orifice and said charge orifice passage.

2. A fuel injector for an internal combustion engine, said fuel injector including a housing means having an inlet port for connection to a source of high pressure fuel, a return port for connection to a fuel return for fuel at low pressure, fuel return passage means adjacent to one end of said housing means in communication at one end with said return port, a spray tip outlet means at the other end of said housing means, a control means including a spring-biased injector valve slidably mounted in said housing means for controlling flow through said spray tip outlet means, said injector valve providing with said housing means a fuel chamber surrounding said injector valve in communication with said spray tip outlet means as controlled by said injector valve, first passage means including check valve controlled supply orifice means in communication with said inlet port and with said fuel chamber, second passage means including an electromagnetic actuated, normally open, valve controlled bleed orifice and an axially spaced apart normally closed, valve controlled charge orifice with a control chamber therebetween in said housing means, said bleed orifice being in communication with said fuel return passage means and at its other end with said control chamber and said charge orifice being in communication at one end with said first passage means and at its other end with said control chamber and axially aligned with said bleed orifice, said housing means providing a stepped cylinder therein defining a first cylinder of predetermined internal diameter and a second cylinder of smaller diameter than said first cylinder, said second cylinder being in communication with said first passage means intermediate said check valve means and said fuel chamber a control orifice passage means having a control orifice of smaller diameter than said bleed orifice in communication at one end with said control chamber and at its other end to one end of said first cylinder opposite said second cylinder, and a stepped piston reciprocable in said stepped cylinder, said stepped piston being operable to increase the pressure of the high pressure fuel in said second cylinder.

3. A fuel injector according to claim 2 wherein said electromagnetic actuated, normally open valve controlled bleed orifice and said axially spaced apart normally closed valve controlled charge orifice further includes a solenoid having a movable armature supporting a pair of opposed valve elements movable therewith between a first position to control the flow of fluid through said charge orifice into said control chamber while blocking flow of fluid from said control chamber out through said bleed orifice and a second position blocking flow of fluid through said charge orifice into said control chamber while permitting flow of fluid from said control chamber through said bleed orifice and a spring means operatively connected to said armature normally biasing said valve elements to said second position.

* * * * *